United States Patent [19]

Ott

[11] 4,102,034

[45] Jul. 25, 1978

[54] PART ORIENTING AND FEEDING MECHANISM

[76] Inventor: Clyde E. Ott, c/o Pace Precision Tool & Die Co., Ohio Ave., DuBois, Pa. 15801

[21] Appl. No.: 719,341

[22] Filed: Aug. 31, 1976

[51] Int. Cl.[2] ..... B21D 43/04; B26D 5/22

[52] U.S. Cl. ..... 29/565; 10/169; 72/424; 83/229

[58] Field of Search ..... 29/565, 566, 33 M; 198/723, 795; 83/228, 229; 10/11 T, 12 T, 72 T, 76 T, 169; 72/424

[56] References Cited

U.S. PATENT DOCUMENTS

| | | | |
|---|---|---|---|
| 420,931 | 2/1890 | Dunham | 10/72 T |
| 2,633,193 | 3/1953 | Thompson | 83/229 |

FOREIGN PATENT DOCUMENTS

| | | | |
|---|---|---|---|
| 802,661 | 10/1958 | United Kingdom | 83/229 |

*Primary Examiner*—Othell M. Simpson
*Assistant Examiner*—Z. R. Bilinsky
*Attorney, Agent, or Firm*—Frank B. Robb

[57] ABSTRACT

There is disclosed mechanism for feeding and orienting small parts for performing dieing operations by a progressive die, which mechanism includes guide means to supply parts by gravity, index means to move the parts uniformly to the die in response to movement of a die member and over a distance which may be precisely regulated with means to orient the parts in the die by dowels to precisely position the same for performing an operation on each part.

4 Claims, 5 Drawing Figures

PART ORIENTING AND FEEDING MECHANISM

OBJECTS OF THE INVENTION

It is a principal object of this invention to provide feeding and orienting means which will handle very small parts and upon which precision operations are to be performed, as by dieing certain portions thereof, including flattening, piercing and trimming elements of said parts, it being necessary to effect feeding of the parts in precision manner and to that end in successive increments therefor.

A further object of the invention is to provide mechanism which will perform the feeding of small parts which are initially supplied to the feeding mechanism by gravity or similar means, moving the parts precisely a distance predetermined, and which distance may be varied, with a ratchet arrangement, the parts entering the dieing mechanism or die as the case may be, so as to be located and moved by abutment of one part against another, into position for the operation to be performed thereon and at the same time during certain of those operations to effect a precise location of the part because of the size thereof and shape being critical and dependent upon the arrangement to effect a final precise location of an operation to be performed.

Another object of the invention is to provide novel mechanism which will move parts progressively by ratchet means, which ratchet means will move the parts in one direction only, and in response to movement of the die parts so that the parts will be positioned for operation on the same by the die and move successively by abutment of one against the other into locations where further precise positioning of the parts may be effected by elements of the die.

Another object of the invention is to provide ratchet mechanism which is relatively simple and yet resiliently arranged for adjustment with stop means to limit and precisely determine the distance of movement of the parts as they are required in response to movement of the die itself during a progressive operation to be performed thereon in a dieing operation.

Other and further objects of the invention will be understood from a consideration of the specification appended hereto and disclosed in the drawings, wherein.

Figures 1, 4, 4A:
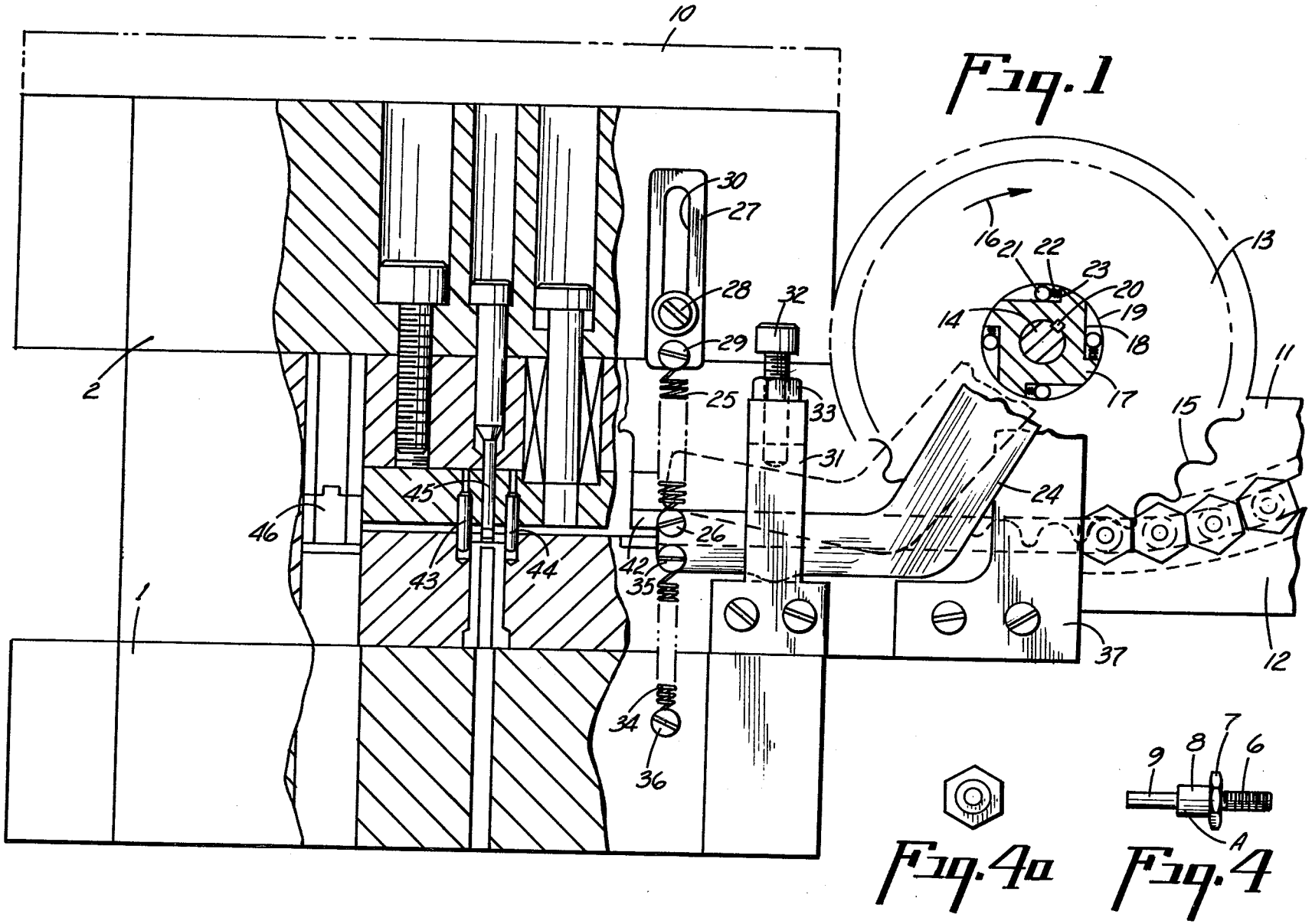
FIG. 1 is a fragmentary elevational view, showing the die and the feeding mechanism arranged in conjunction therewith.

FIGS. 4 and 4*a* are views of one of the parts which the mechanism hereof is intended to feed and orient.

DESCRIPTION OF THE INVENTION

Figure 3:
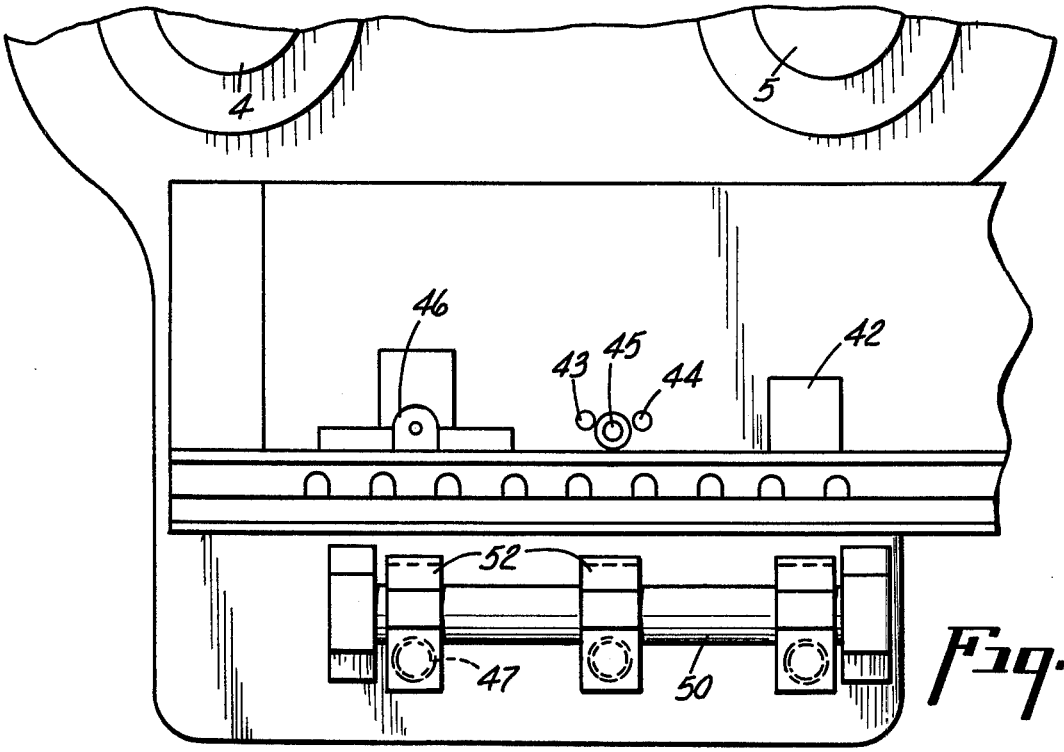
FIG. 3 is a view somewhat diagrammatic, but illustrating the relationship of certain of the parts of the die which perform the operation, as well as positioning means provided for parts in the die.

Referring now to FIG. 1, it is noted that the invention hereof is to be used in conjunction with a progressive die, which die is shown in general outline as comprising a lower portion of the die set, designated 1, the die holder or upper portion 2, and as will be seen upon reference to FIG. 3, suitable guide pins such as 4 and 5 are arranged in the die so that they will guide the upper and lower elements precisely with respect to one another, and thereby absolutely determine that the operations performed by the die elements will be consistent and located precisely with respect to the parts passing therethrough.

As will be understood from a consideration of FIG. 1, the parts being operated on are quite small and as shown in detail in FIGS. 4 and 4*a*, include a threaded end portion 6, a hex center portion 7, a cylindrical body 8, with a rod-like extension 9 of said body, the portion of the part generally just described upon which the operation herein is to be performed being the rod-like extension of the body designated 9 which is to be flattened, pierced and thereafter trimmed.

As will be obvious, the parts of the die set 1 and 2 are designed to move with respect to one another, that is the upward member 2 moves up and down as suggested by the dotted line 10, being the upper extremity of movement of the upper die part, with certain of the elements in the die to perform the operations previously mentioned with respect to the description of the part involved.

With this in mind, therefore, it will be pointed out that suitable guide means are provided in the form of an upper guide rail 11 and a lower guide rail 12 between which the parts which are, for the purposes hereof, designated as A are designed to be positioned, and since the guide rails 11 and 12 are upwardly curved as suggested in the drawing, the parts will move by gravity with the flats of the hex head 7 thereof adjoining and in contact with one another through and downwardly in the guide rails 11 and 12.

The guide rails carry the parts A into a position for engagement by an index wheel 13, which index wheel 13 is mounted on a shaft 14 and is provided at its periphery with a series of uniformly spaced and precisely positioned openings 15, adapted to engage with the cylindrical body 8 of the parts A.

It will be apparent that a series of the parts are engaged by the cylindrical portions A by reason of tne size of the index wheel 13, the movement of the index wheel in a clockwise direction as suggested by the arrow 16 will cause the part to move by engagement of the openings 15 with the said cylindrical bodies thereof.

Now in order to move the index wheel 13, a ratchet wheel arrangement is provided interiorly or centrally thereof, the ratchet wheel hereof being designated 17, and having on its periphery a series of formations designated 18 which include the flat portion thereof and arranged so that this flat intersects the interior circular opening 19 formed in the index wheel 13.

The index wheel shaft 14 is provided with a key 20 which engages the ratchet wheel 17, and the formations 18 are arranged in such a manner that suitable ball bearings such as 21 under the pressure of the springs 22 positioned as disclosed, against suitable ends 23 of the formations 18, will cause the ball bearings 21 to engage and normally be maintained in contact with the circular opening 19 previously referred to.

The shaft 14 is additionally connected to a ratchet arm 24 which as will be seen from FIG. 1 extends downwardly and leftwardly with the dotted line position of said arm being illustrative of its movement into one position as will be subsequently described, the movement of the arm causing the ball bearings 21 to be moved along the portions 18 and engage with the circular opening 19 of the index wheel, thereby causing the index wheel to be moved a predetermined amount.

In order to move this index arm 24, a spring 25 is attached as by the machine screw 26 to the upper die member 2 by means of a lifter 27 which is fastened by a machine screw 28 to said die member 2.

The spring 25 will be connected at its upper end by a machine screw 29 to the lifter 27, the lifter 27 having the elongated opening 30 therein for adjustment purposes as will be clearly understood.

It will therefore be apparent that when the die is opened as will be the case when it is in position in a punch press or the like, it will cause the arm 24 to be moved by the spring 25 and in turn rotate the index wheel 13 to move the parts A to the left as viewed in said disclosure.

In order to limit the amount of movement to a precise predetermined amount, a suitable stop arrangement is provided including the member 31, which extends upwardly and through which the arm 24 passes, having a suitable stop adjustment screw 32 threadedly engaged with the stop member 31 and a locknut 33 to maintain the screw 32 in a predetermined position.

It will be observed that by adjusting the stop screw 32 the distance of movement of the arm 24 may be regulated very precisely, irrespective of the amount of movement of the die part 2 as long as the spring produces enough pressure, the spring 25 that is, to move the arm 24 sufficiently and thereby the index wheel 13 likewise.

In order to return the arm 24 to initial position for again moving parts A, a return spring 34 is provided, fastened as by the screw 35 to the arm at the upper end of the spring, and to the lower die part at 36.

Figure 2:
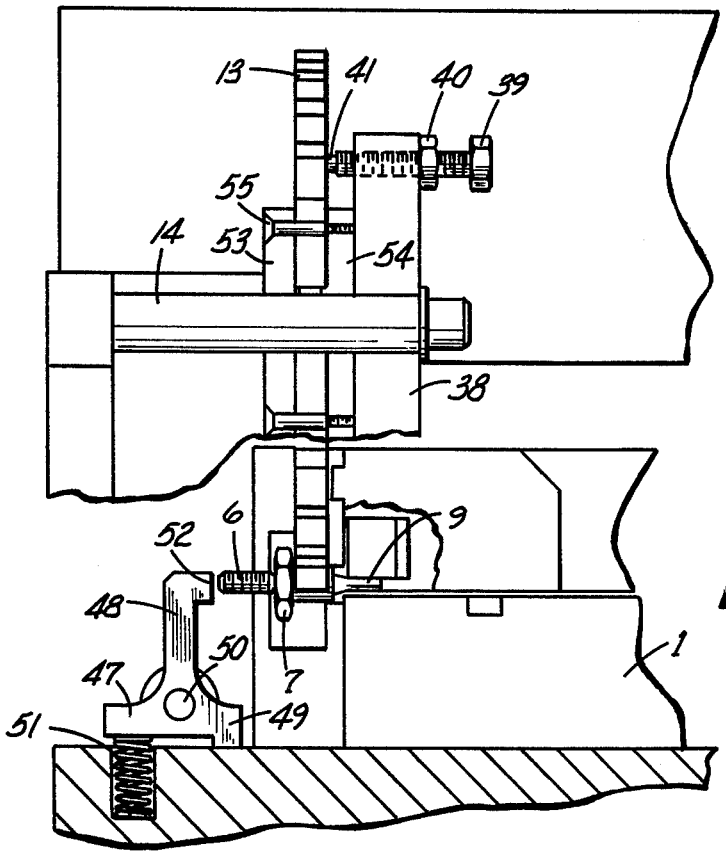
FIG. 2 is a fragmentary view, showing the feeding mechanism from one end and certain elements thereof in specific detail.

It is noted that the index wheel and associated parts are supported adjacent the die by means of an outboard support member 37 as shown in FIG. 1, and an inboard support member 38 as shown in FIG. 2.

FIG. 2 is again referred to, since the upper end of the inboard support member 38 may desirably have a brake part provided thereon, in the form of a machine screw part 39 with a locknut 40 positioned thereon; passing through the upper end of the support member 38 in a threaded opening therein, the end of the screw 39 being provided with a suitable plastic or other similar material designated 41 to engage with the face of the index wheel 13 with sufficient frictional engagement to maintain the index wheel in position once it is moved by the arm 24.

Since the index wheel is arranged to move the parts A a specific distance in each case by suitable operation of the die part 2 and the arm 24 driven thereby, to initially locate the part in the die, for flattening by the flattening element generally designated at 42, for the upper movable die member and this will cause the part, specifically the rod-like extension thereof to be flattened, this being the portion 9, subsequent rotation by the index arm 24 or ratchet arm 24, moving the part to a position where it is engaged by the dowels 43 and 44 or therebetween, these dowels passing at opposite sides of the cylindrical body 8 so that the now flattened portion 9 may be pierced by a suitable piercing punch 45, it being noted that inasmuch as the flats of the parts A maintain the parts by contact in the specific relationship once established so that when the flattened portion of the parts A moves to position for punching by the punch 45 and between the dowels 43 and 44, the part will be precisely punched at that place, there being a trim die element 46 provided to trim the flattened portion once it is punched.

Subsequent movement of the ratchet arm 24 will of course cause the part A now finished, to be forced outwardly from the die and be carried off in the conventional manner not herein further described.

Since it is also necessary to maintain the parts in the die from front to rear thereof in precise location with respect to the large hex portion 7, a suitable set of pusher fingers is provided, these being in the form of T-shaped members located with the heads thereof downwardly, the heads being designated 47, the upright portion 48 and the member as a whole 49 being pivoted at 50 on the lower portion of the die which is supported on the bolster of the punch press or the like.

This pusher finger arrangement is, as shown in FIG. 3, provided so that in each one of the positions of the part for operation, namely by the flattening element 42, the punching element 45 as positioned by the dowels 43 and 44, subsequent positioning of the part A for trimming by the trim die element 46 likewise having a pusher finger positioned opposite thereto so that in all positions where operations are to be performed, pusher fingers are positioned, these being maintained in desired location by suitable springs 51, these springs being arranged to push upwardly on the outer ends of the heads of the members so that the upper portions thereof and particularly the inward facing contact 52 will abut the end of a part A, opposite thereto, and thus cause the hex portion 7 to be in each case maintained in precise relationship to the acting part of the die as previously indicated.

It will be appreciated that since the upper die part 2 moves up and down in response to operation of the punch press, that these operations take place in response to this way of movement, and thus are timed by such movement, the parts moving along in sequence and in precise position as indicated for operation thereon.

It is noted that the ratchet wheel 17 and associated parts is maintained in position with regard to the index wheel 13 by suitable cover members such as 53 and 54 suitably fastened to the wheel 13 by machine screws 55 passing therethrough.

I claim:

1. In part feeding and orienting mechanism of the class described, in combination, means to perform dieing operations on parts, guide means to carry such parts toward feeding mechanism connected to said dieing means, said mechanism including an index member to engage the parts and maintain them in spaced relation, means to move the member and each part engaged therewith a predetermined distance in timed relation to the dieing operation, each part so moved, engaging the part ahead thereof to move that part to position for performing said operation thereon, and orienting elements in the dieing means positioned to engage each part separately after such movement and precisely locate the same for performing said operation, the means to perform dieing operations comprise a progressive die to perform successive operations on the parts in separate steps as such parts move to successive positions, the guide means provide gravity supply of such parts toward the feeding mechanism, the feeding mechanism includes an index wheel having part engaging portions thereon, ratchet means connected to the die for movement by a movable part of said die, being provided to move said index wheel a predetermined distance and thus the parts engaged thereby likewise, and means to control the said movement.

2. The combination as claimed in claim 1, wherein the ratchet means include a ratchet wheel engaging the index wheel, a ratchet arm is provided to drive said wheel, the arm is connected to a movable die part, and stop means are adjustable to regulate the distance of movement of the arm.

3. The combination as claimed in claim 1, wherein the guide means include upwardly curved upper and lower guide rails, the parts placed therebetween have portions which initially provide spaces therebetween when positioned in abutting relation, the index wheel part engaing portions are arranged peripherally to engage such portions, the ratchet wheel engages the index wheel to move the same in one direction of rotation, the ratchet arm is connected to the ratchet wheel and said arm is connected to said die part by a resilient member to effect the movement aforesaid.

4. The combination as claimed in claim 3, wherein the arm is returned to initial position by resilient means.

* * * * *